US006883284B1

(12) United States Patent
Burgunder et al.

(10) Patent No.: US 6,883,284 B1
(45) Date of Patent: Apr. 26, 2005

(54) MASONRY WALL DEVICE

(76) Inventors: Paul R. Burgunder, 128 Cherrydell Dr., Pittsburgh, PA (US) 15220; John Koester, 3309 Lachman Court NE., St. Michael, MN (US) 55376

( * ) Notice: Subject to any disclaimer, the term of this patent is extended or adjusted under 35 U.S.C. 154(b) by 48 days.

(21) Appl. No.: 10/394,883

(22) Filed: Mar. 21, 2003

(51) Int. Cl.[7] ..... E04F 17/08
(52) U.S. Cl. ..... 52/302.1; 52/302.3; 52/169.5; 52/426; 52/361; 52/424
(58) Field of Search ..... 52/302.1, 302.3, 52/169.5, 169.14, 11, 378, 379, 381, 383, 52/424, 426, 404.2

(56) References Cited

U.S. PATENT DOCUMENTS

| | | | | |
|---|---|---|---|---|
| 2,705,887 A | | 4/1955 | Xanten | 72/128 |
| 4,282,691 A | | 8/1981 | Risdon | 52/101 |
| 4,545,161 A | | 10/1985 | Baumann | 52/235 |
| 4,612,742 A | * | 9/1986 | Bevilacqua | 52/169.5 |
| 4,852,320 A | | 8/1989 | Ballantyne | 52/303 |
| 4,907,385 A | | 3/1990 | Biodrowski | 52/169.5 |
| 5,230,189 A | | 7/1993 | Sourlis | 52/169.5 |
| 5,343,661 A | | 9/1994 | Sourlis | 52/169.5 |
| 5,598,673 A | | 2/1997 | Atkins | 52/302.1 |
| 5,845,455 A | | 12/1998 | Johnson, III | 52/713 |
| 5,937,594 A | | 8/1999 | Sourlis | 52/169.5 |
| RE36,676 E | | 5/2000 | Sourlis | 52/169.5 |
| 6,254,039 B1 | * | 7/2001 | Zimmerman | 248/48.2 |
| 6,663,317 B1 | * | 12/2003 | Williams et al. | 405/48 |
| 2003/0126810 A1 | * | 7/2003 | Brunson et al. | |
| 2003/0230035 A1 | * | 12/2003 | Collins et al. | |

* cited by examiner

*Primary Examiner*—Carl D. Friedman
*Assistant Examiner*—Nahid Amiri
(74) *Attorney, Agent, or Firm*—Armstrong, Kratz, Quintos, Hanson & Brooks, LLP

(57) ABSTRACT

A device for use in structures having masonry cavity wall construction for promoting removal of water and water vapor between a masonry exterior wall and a structural back-up wall. A plurality of the devices, which are elongated and have a generally "V" shape, are arranged in a systematic pattern in order to catch and retain trash mortar during a construction phase of the structure. Following construction, the device, which includes a wicking material to transport accumulated water beyond ends of the device, functions to promote the removal of water and water vapor in the cavity so as to prevent deterioration of the building materials of the walls.

25 Claims, 10 Drawing Sheets

MASONRY WALL DEVICE

FIELD OF THE INVENTION

The present invention relates to a device for use in structures having masonry cavity wall construction. The device is for promoting removal of water and water vapor between an exterior masonry wall and a structural back-up wall of the structure during the lifetime of the structure.

BACKGROUND OF THE INVENTION

In a type of masonry wall construction for buildings, known as cavity wall construction, a structural back-up wall of concrete block, structural clay tile units, poured concrete, or wood or steel framing with attached sheathing material, is spaced from the structure's exterior masonry wall consisting of brick or other unit masonry. The cavity or space between the structural back-up wall and exterior masonry wall is typically from 1–4 inches. In cavity wall construction, it is important to remove water and water vapor in the cavity in order to prevent damage to materials of the walls and to maintain the strength and appearance of the walls. Water and water vapor can be present in the cavity for a number of reasons, including condensation of moisture in the air, migration of water and water vapor through the exterior masonry wall, cracks and other openings in the exterior masonry wall, water leaks in the roof or elsewhere in the building, water and water vapor migrating from the building interior through the structural back-up wall, and various other reasons. Water and water vapor in the cavity is usually an on-going condition which cannot always be eliminated. The presence of water or water vapor can cause degradation of the construction materials of the exterior masonry wall, the structural back-up wall, or even the foundation. If not controlled during freezing conditions, serious damage can occur. The presence of water and water vapor can migrate to the interior and promote the growth of mold, and can migrate through the exterior masonry wall forming an unsightly deposit of salts or efflorescence on the exterior face of the wall, or unsightly streaks from the corrosion of metal building components associated with the walls.

Water vapor can be removed or reduced in the cavity with use of vents from the cavity through the exterior masonry wall to the outside air. The vents are preferably located both near the top and bottom of the wall so as to promote air currents through the cavity. Water can be removed or reduced in the cavity by a weep system at the base of the cavity for removing water which makes its way to that location. In a weep system, openings are provided through the exterior wall to transport the water to the outside.

Although a weep system can work well, it is often prevented from working as designed due to the presence of "trash mortar" which drops into the cavity and generally collects at the bottom of the cavity during construction of the exterior masonry wall. The amount of trash mortar collected at the bottom can vary greatly depending on the height of the exterior masonry wall, the masonry unit installation technique employed by the mason, the consistency of the mortar, working conditions, etc. The trash mortar can block the openings of a cavity weep system and vents and impede the removal of the water and water vapor.

Various systems have been developed for preventing trash mortar from dropping to the base of the walls. One system, found in U.S. Pat. No. 5,598,673, incorporates a coarse polymer mesh material for substantially filling the cavity and preventing the mortar from falling to the bottom of the cavity. It must be installed to the exterior face of the structural back-up wall prior to laying-up the exterior masonry wall. The system requires a significant added construction step and somewhat restricts the free-flow of air in the cavity after installation. Moisture condensing in the cavity, or water otherwise present in the cavity, is presented with a torturous route in order to reach a cavity weep system at the base of the walls, thus delaying its removal. The coarse polymer mesh material, which makes contact with both walls, can hold water moisture at contact points on the surfaces of the walls facing the cavity, thus subjecting the material of the walls to water and water vapor over long periods of time.

U.S. Pat. Nos. Re. 36,676, 5,230,189 and 5,343,661 describe a water-permeable material which is generally placed at the bottom of the cavity. As in the previous device the material makes contact with the walls and condensed water, or water otherwise found on the water permeable material, eventually makes its way to the weep system at the base of the walls. This method is effective in holding mortar above the bottom of the cavity, however it does present limitations, in that, although it collects trash mortar on the top surface of the mesh material at various elevations, it does not prevent the mortar from simultaneously touching the inside of the masonry wall and the face of the structural back-up wall, resulting in a condition referred to as "bridging". The bridging mortar can provide a route for water to travel from the inside of the exterior wall to the structural back-up wall. Also, although it collects trash mortar on the top surface of the mesh material at various elevations, it does not prevent an uncontrolled amount of excessive mortar from building up to the point where the flow of water and air is inhibited.

A system described in U.S. Pat. No. 4,282,691 features a device for allowing the escape of water from a wall cavity by providing an exit through the exterior wall. The device includes a tube having a water outlet and an inlet, with an elongated porous wick material extending outwardly from the water inlet to absorb water and water vapor. In operation, water seeps from the wick end to the outlet end. A plurality of tubes are inserted through the exterior wall near the base of the walls. The system does not provide a means for preventing trash mortar from dropping from upper levels to the base of the walls and therefore proper operation of the device can be impeded by the presence of the mortar.

Another system, U.S. Pat. No. 5,845,455, uses an elongated sheet collecting device positioned in the cavity and attached to the masonry ties to prevent mortar from accumulating in the bottom of the cavity and blocking weep holes. This method is effective in holding mortar above the bottom of the cavity, however it does present limitations. It can only be used in conjunction with a limited number of masonry tie systems, and although it collects trash mortar, it does not prevent that mortar from bridging across the cavity, which could provide a route for water on the inside of the exterior wall to travel to the structural back-up wall.

It is an object of the present invention to provide a device for preventing trash mortar, in cavity wall construction, from dropping to the base of the masonry wall, primarily during the construction phase of a building and not allowing that mortar, which it collects, to bridge across the cavity, and to provide a means for promoting rapid removal of water and water vapor in the cavity during the life of the structure.

It is a further object of the present invention to provide a device for promoting transfer of water in the cavity to a base weep system in a minimum amount of time and directing the water away from the surfaces of the walls which face the cavity.

It is yet a further object of the present invention to provide a device which does not require a significant added construction step or significant deviation from conventional construction procedures and conventional tie devices used by masonry tradesmen.

It is yet a further object of the present invention to provide a device which does not result in the bridging of mortar between the walls.

SUMMARY OF THE INVENTION

The present invention is a device for use in masonry cavity wall construction for collecting trash mortar and promoting removal of water and water vapor in a cavity between an exterior masonry wall and a structural back-up wall. The device includes an elongated trash mortar collecting means for insertion, during construction, between an exterior masonry wall and a structural back-up wall. The device extends longitudinally in the direction of the faces of the walls to prevent trash mortar from dropping below the location of insertion, and includes a water wicking means for transporting water present on the collecting means to locations beyond ends of the collecting means, for releasing to a location in the cavity which is removed from surfaces of the walls and which is below the location of insertion.

BRIEF DESCRIPTION OF THE DRAWINGS

The invention will become more readily apparent from the following description of preferred elements shown, by way of example only, in the accompanying drawings, wherein.

DETAILED DESCRIPTION

Figure 1:
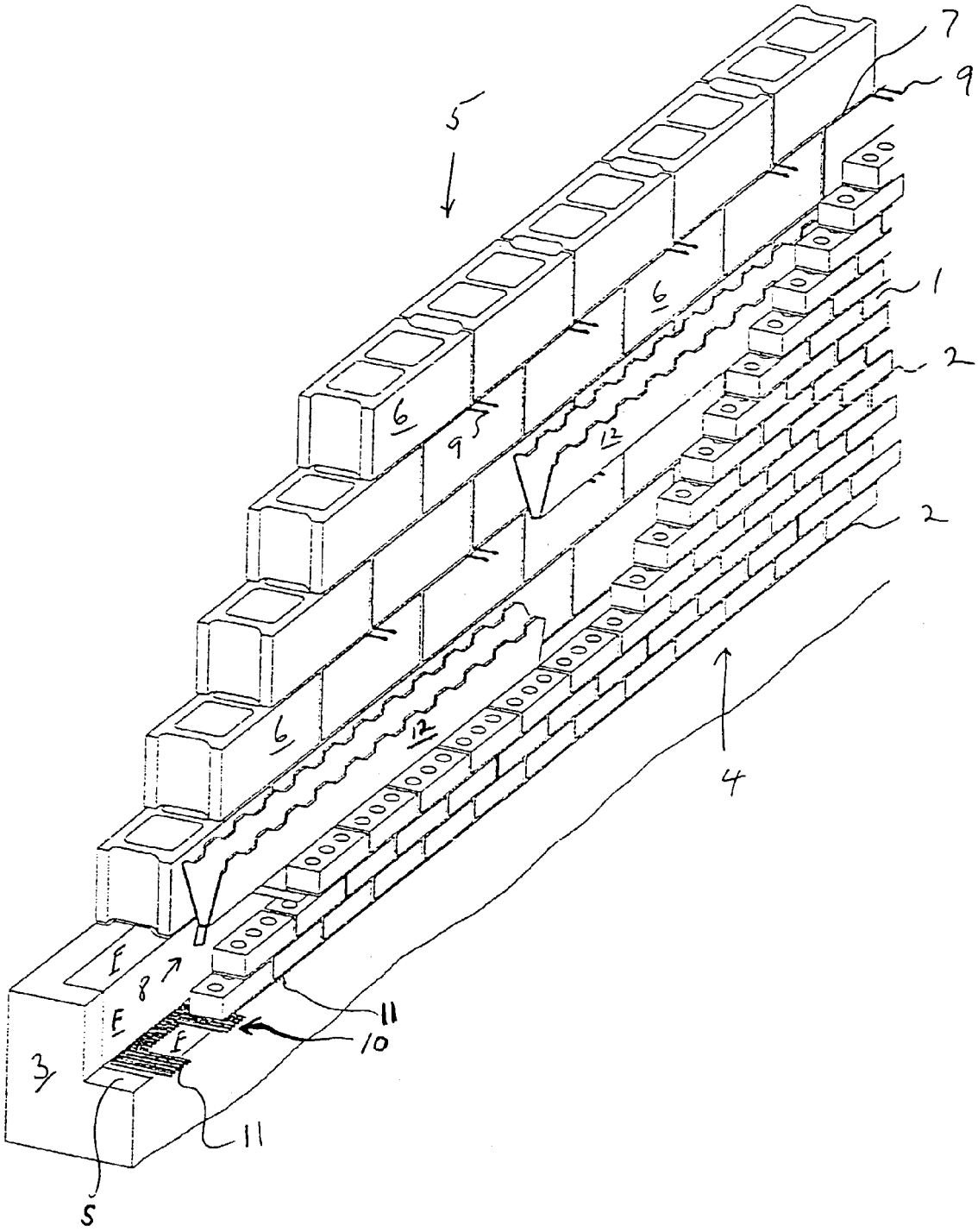
FIG. 1 is a perspective view of cavity wall construction, having installed therein devices of the present invention.

FIG. 1 depicts masonry cavity wall type construction wherein facing bricks 1 having mortar joints 2 are laid-up on foundation wall 3 to form an exterior masonry wall 4 of a building. In this example a structural back-up wall 5 consists of concrete blocks 6 having mortar joints 7. Other types of construction can use a structural back-up wall of wood or metal studs having attached outward facing sheathing board, structural clay tiles, poured concrete or the like. Regardless of the material of the structural back-up wall, cavity wall type construction results in a cavity 8 being formed between the exterior masonry wall 4 and the structural back-up wall 5. Typically the width of the cavity is 1–4 inches and the width is substantially uniform over the length and height of the walls. In order to provide an exterior masonry wall with rigidity against wind loads or other forces which might be present, as well as to provide a more solid structure, ties 9 are provided to extend from the structural back-up wall 5 into mortar joints 2 in the exterior masonry wall 4. In construction having a concrete block structural back-up wall, ties are typically placed about 16 inches apart along each second course of blocks as measured on a vertical line and are separated a distance of approximately 16 inches as measured on a horizontal line. In construction using other than concrete blocks for the structural back-up wall, other type of anchor and tie system are provided having a similar spacing arrangement.

In the masonry cavity wall construction depicted in FIG. 1, a weep system 10 is shown having openings 11, which extend under the lowest mortar joint 2 of exterior masonry wall 4. The openings preferably extend across the top of flashing F located on brick shelf 5 and they provide a pathway for the flow of water which makes its way to the base of cavity 8. Weep systems other than that shown in FIG. 1 are known, and can be used effectively in combination with the present invention. The performance of the weep system shown, as well as other weep systems, becomes compromised and in some cases inoperative, when mortar, known as trash mortar, which drops down the cavity from mortar joints when exterior wall masonry units are being laid, accumulates at the base of the cavity. In a multi-story building the amount of trash mortar, which can accumulate can be significant. The accumulated mortar builds up on the flashing F, which covers the brick shelf S of foundation wall 3, and on top of or behind weep system 10, and slows or stops the flow of water from the cavity through the weep system.

It is a function of the present invention to capture and retain the trash mortar during the wall construction period and to prevent such accumulation at the base of the cavity. Other functions carried out by the device during the life of the structure, are described below.

Figure 2:
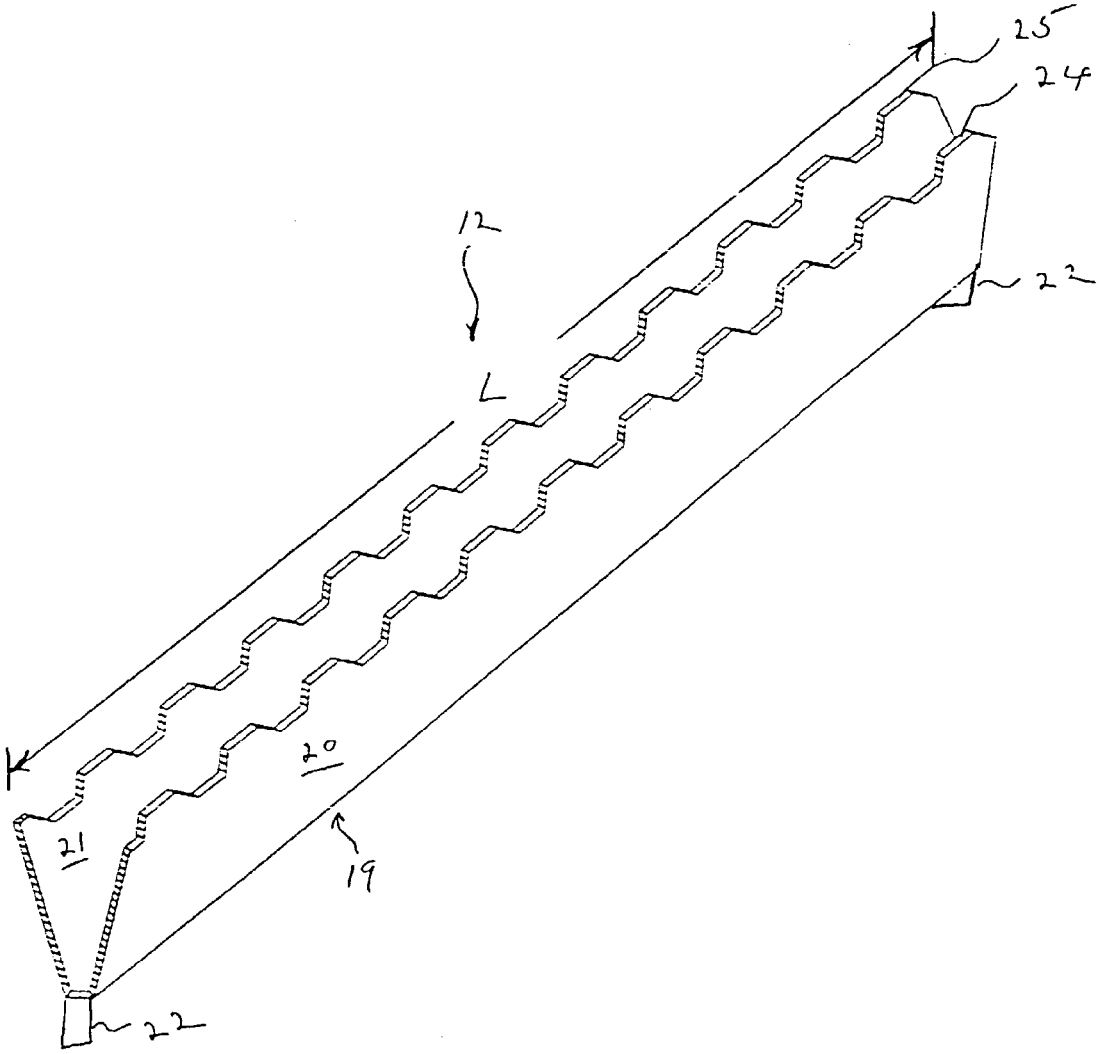
FIG. 2 is a perspective view of the water and water vapor removal device of the invention.
Figure 3:
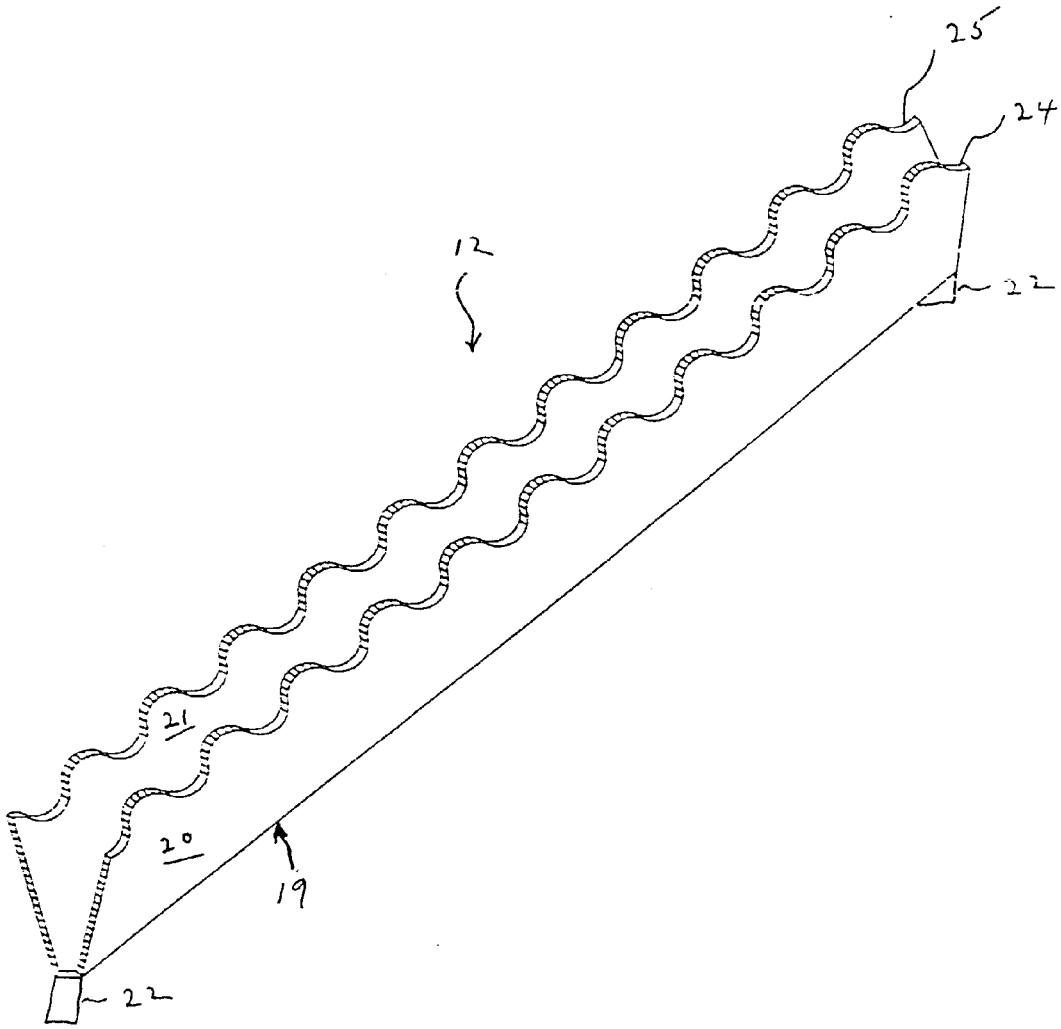
FIG. 3 is a perspective view of another embodiment of the water and water vapor removal device of the invention.

The trash mortar collection device 12 of the present invention, designed to promote water and water vapor escape, is shown in FIGS. 2 and 3. The preferred placement of the device 12, shown in FIG. 1, is across at least two ties 9 so as to be in a stable, substantially horizontal position.

Figure 4A:
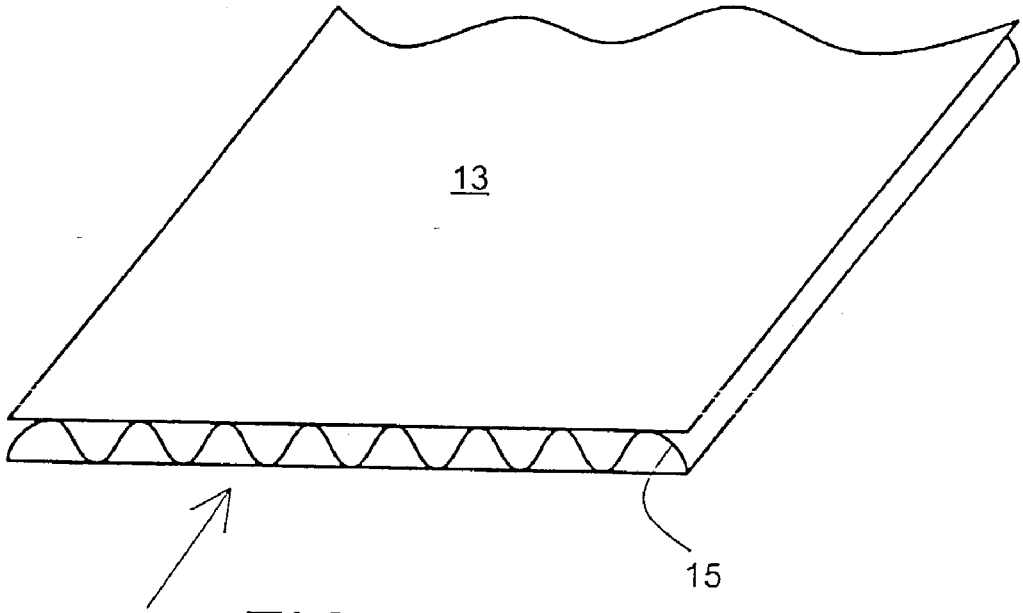
FIGS. 4A and 4B are perspective views of materials for use in fabricating the water and water vapor removal device of the invention.
Figure 4B:
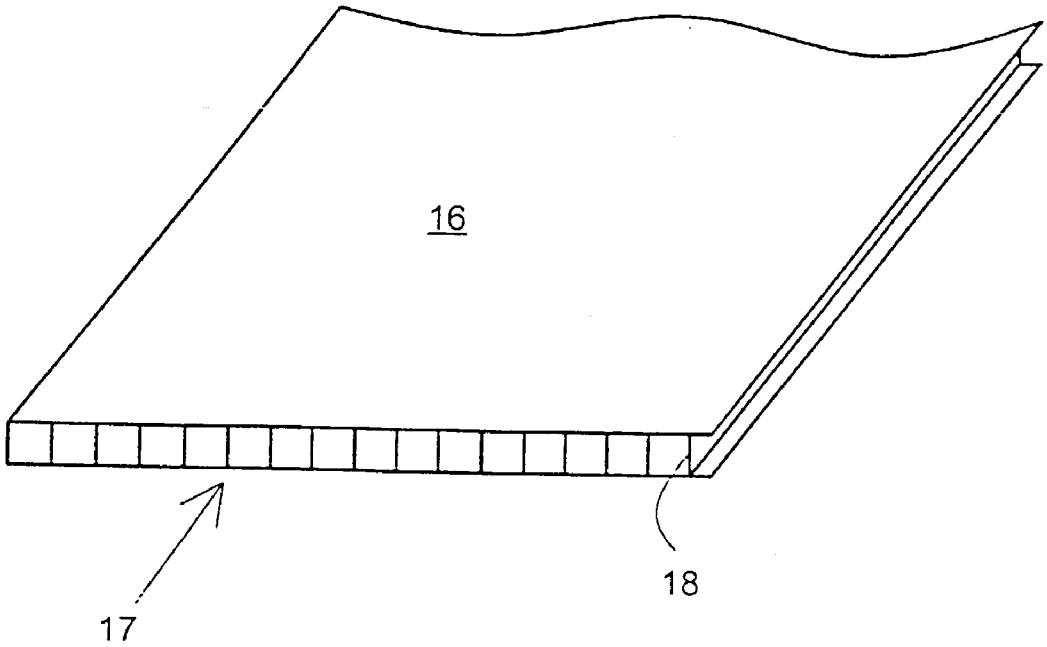
Figure 4C:
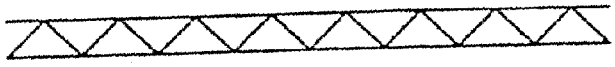
FIGS. 4C–4M are examples of other materials for use in fabricating the trash mortar collecting device of the invention used to promote water and water vapor removal.
Figure 4D:
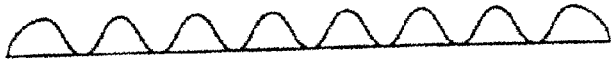
Figure 4E:
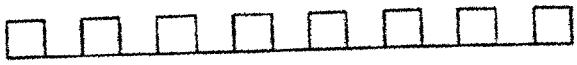
Figure 4F:
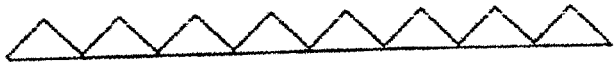
Figure 4G:
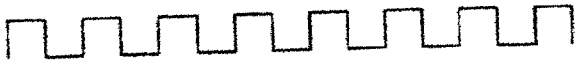
Figure 4H:
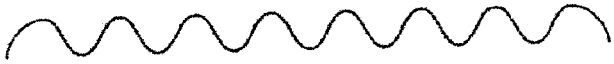
Figure 4I:
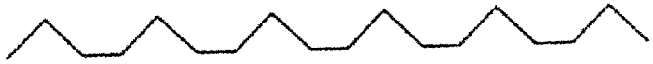
Figure 4J:
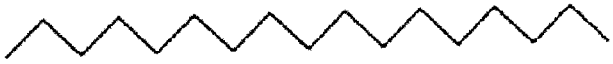
Figure 4K:
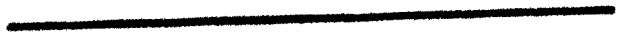
Figure 4L:
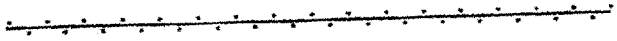
Figure 4M:
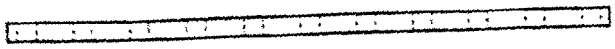

Referring to FIGS. 4A through 4M, the device of the invention is fabricated of a rigid substantially flat material which can tolerate water and water vapor without deteriorating or losing rigidity, which is chemically compatible with mortar or other materials of the walls, and which is unaffected by the presence of moisture. In view of the fact that the device is expected to function over a long period of time corresponding to the life of the building, a highly stable synthetic resin or polymer material such as polypropylene-ethylene copolymer is preferred. Other materials, including metals, and solid, woven, or perforated sheet materials having the above-described properties are also available in practice of the invention. To significantly improve rigidity, without adding significant weight and cost, the preferred embodiment is fabricated of an unfaced, single, or double faced corrugated material; an unfaced, single or double faced ribbed material; a solid sheet material; a woven sheet material or a perforated sheet material as depicted in FIG. 4A through FIG. 4M respectively. In FIG. 4A, parallel diaphragm facings 13 and 14 are separated and supported by corrugated member 15 consisting of alternating furrows and ridges. In FIG. 4B, parallel facings 16 and 17 are separated and supported by ribs 18. When fabricated in a preferred method, with ribs or corrugation running in the longitudinal direction of the device, the double facing shown in FIGS. 4A and 4B provides rigidity in a direction perpendicular to the longitudinal direction, while having the rigidity associated with a ribbed or corrugated material directed in the longitudinal direction. Ribs or corrugation running perpendicular to the longitudinal direction are also possible in practice of the invention. Materials having other forms without a facing, as shown in FIGS. 4G TO 4M, are also possible. Preferably the ribbed, corrugated, solid, woven, or perforated material is fabricated of polypropylene-ethylene copolymer or other stable synthetic resin or polymer sheet material having a thickness in the range of 0.005 to 0.2 inch, and the ribbing or corrugation depth, as applicable, is in a range of 1/32 to 1/2 inch. Solid, woven, and perforated sheets in the same thickness range can also be used.

A preferred length of the device, indicated in FIG. 2 at L, is from 32 to 96 inches, so as to be supported by a minimum of two masonry ties 9. Because of the fact that the devices are placed on the masonry ties during laying-up of the exterior wall masonry unit, and are preferably placed into the cavity after a number of courses of masonry units are laid above the course in which the supporting ties being used are located, and a clear line of sight is not available, an overhang of a reasonable length is provided to assure that support is maintained at a minimum of two points. As an example, if the ties are spaced a distance of 16 inches and the preferred three ties are utilized, a 48 inch device would overhang 8 inches beyond the ties at each end, if centered.

Figure 5A:
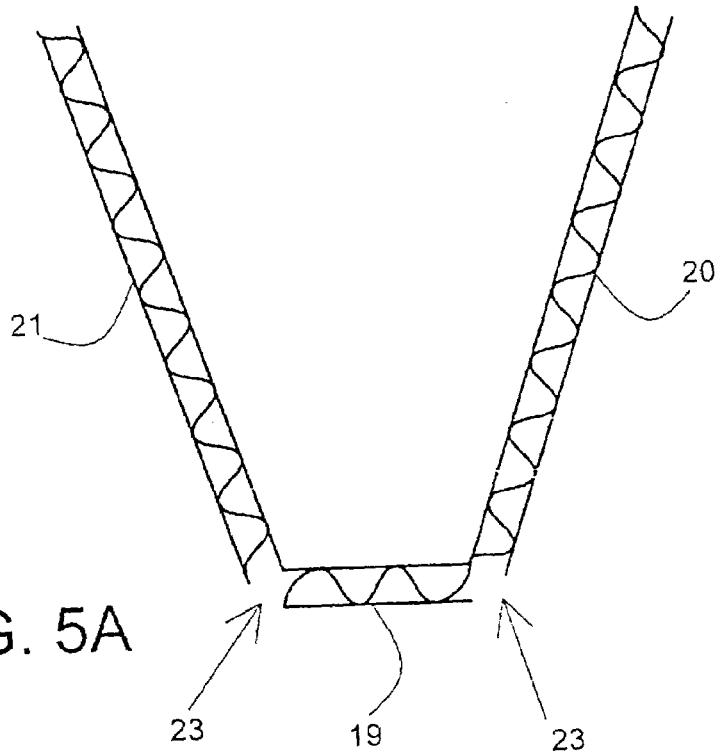
FIGS. 5A and 5B are cross-sectional views, taken in a plane perpendicular to the longitudinal direction of the device of the invention, showing fabricating cuts made in the materials of FIGS. 4A and 4B respectively.
Figure 5B:
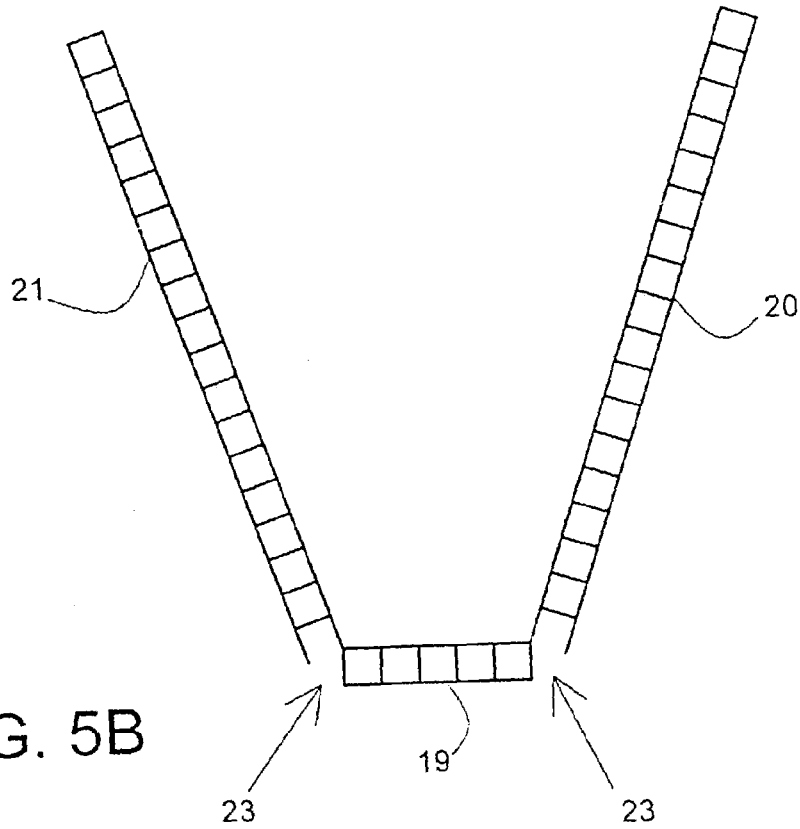

The simplest description of the device is an open-ended trough. As shown in FIGS. 2 and 3, the device has a "modified V" shape, as viewed in the longitudinal direction, preferably with a flat base portion 19 between vertexes at the bases of the straight leg portions 20 and 21. The narrow and elongated flat base portion 19 provides a location for a wicking means 22, discussed below, as well as an increased bearing surface for bearing on the masonry ties. In a preferred embodiment, the straight leg portions 20 and 21, extend upwardly from the vertexes a length of between 5–12 inches. To facilitate forming the "modified V" shape, in a double-faced material, one facing of the corrugated or ribbed material is cut as shown in FIGS. 5A and 5B at 23. This is necessary because of a tendency for the sheet material to assume an original flat configuration, which is associated with forces from an un-cut face, the device tends to assume a flattened configuration unless force is not applied along the longitudinal edges to hold the material in a "modified V" shape.

The longitudinal edges 24, 25 of the device are preferably non-linear as shown in FIGS. 2 and 3, and upon placement of the device on the masonry ties, the edges bear slightly on the exterior masonry and structural back-up walls 4 and 5 of the structure, because of the above-described tendency to assume a flat configuration. The slight outward pressure is not of a magnitude to cause dislodging of the newly installed masonry units. The non-linear, undulating edges allow air to better circulate in the cavity, and also allows water which might flow down the walls, to pass by the device. Examples of different non-linear edges are shown in FIGS. 2 and 3, however practice of the invention is not limited to the shapes shown in the drawings.

A second component of the device of the invention is a wicking means 22 which is disposed along the flat base portion 19 as best viewed in FIGS. 2, 3, and 6A–6E. The wicking means consists of a durable natural or synthetic material such as nylon or polyester, having good wicking properties, which is preferably but not necessarily of a length greater than the length L of the device as shown in FIG. 2. The wicking material has a width at least as wide as the flat base portion 19, and preferably extends at least part way up the surfaces of the trough walls, which extend from each vertex toward each upper longitudinal edge. Extending upward to the top edges of the trough walls is also possible. The length of the wick is preferably 2 to 3 inches longer on each end than the length L of the device in order to enhance the wicking action of the wicking material 22 by utilizing the force of gravity acting on the collected water. Preferably the wicking means is attached to the device with use of an adhesive or a fastening means such as staples to assure that it remains in the proper location.

Figure 6A:
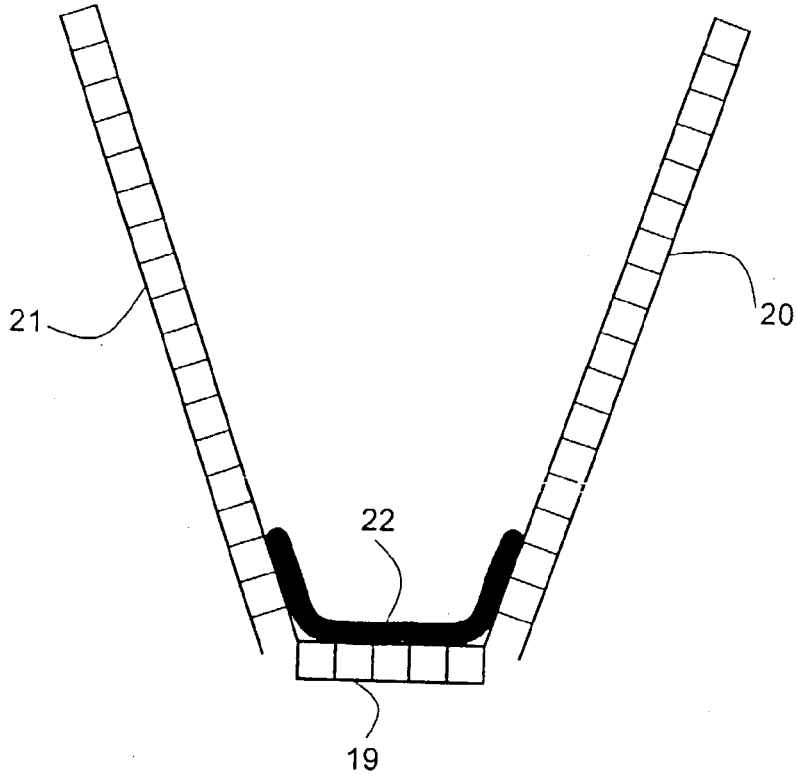
FIGS. 6A–6E are cross-sectional views, taken in a plane perpendicular to the longitudinal direction of the device, showing different embodiments of the device and the placement of wicking material in the device of the invention.
Figure 6B:
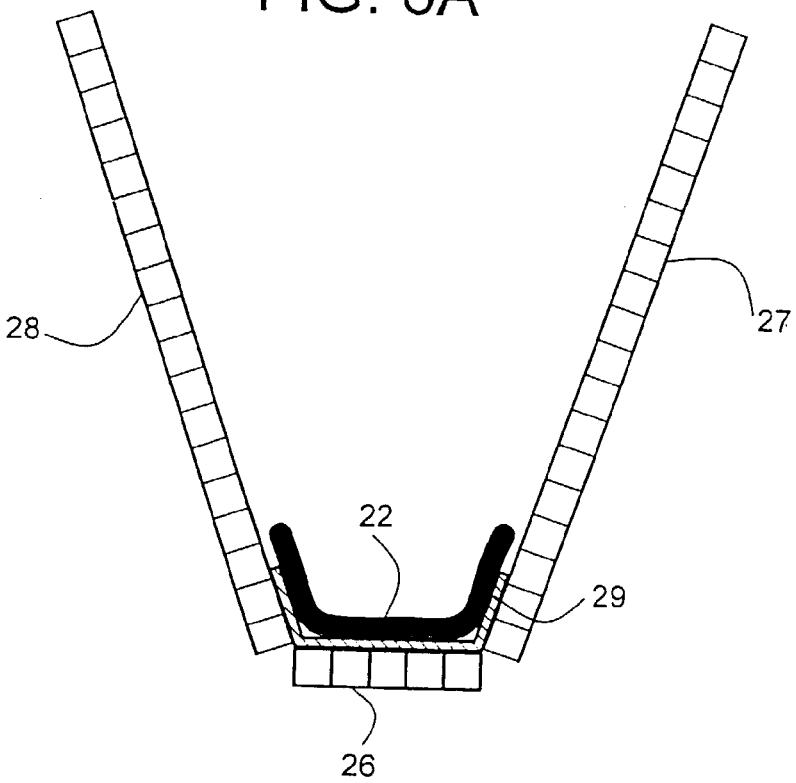
Figure 6C:
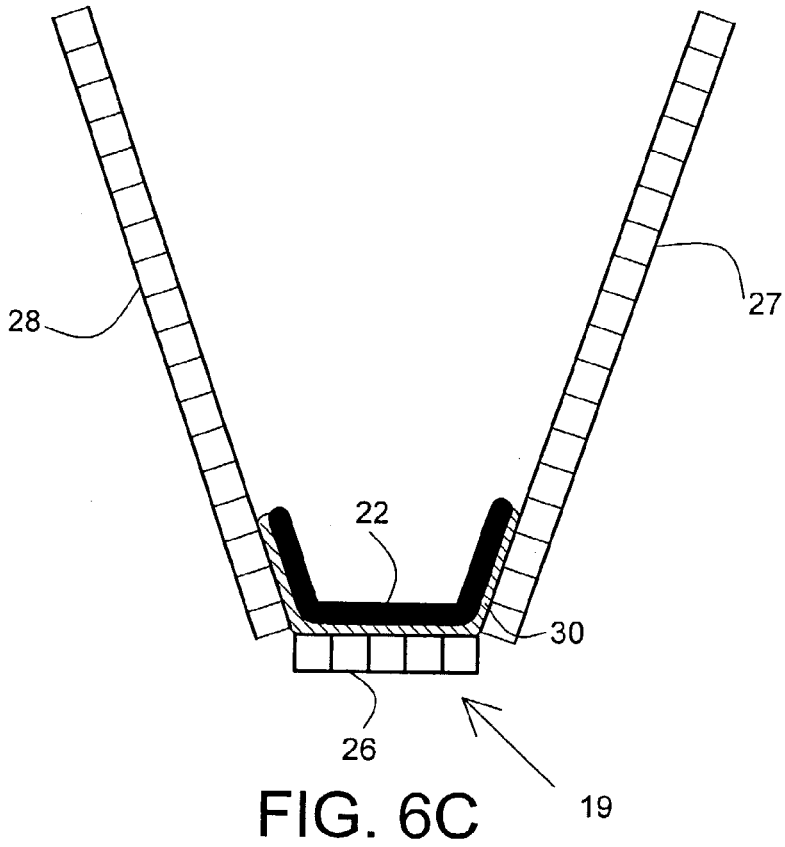

In another method of fabricating the device of the invention, separate pieces of material, to form the "modified V" shape, can be used. The individual pieces can be held together in the proper configuration with use of a polymer tape-like material, or adhesive. The adhesive can be applied between each of the separate pieces and a wicking means, described above, to hold the device together in the proper configuration. Referring to FIG. 6B, individual pieces 26, 27 and 28 are held together in the proper configuration with use of a polymer tape-like material 29 which is adhesively attached to adjoining pieces. In the embodiment of FIG. 6C, solely an adhesive layer 30, between wicking means 22 and individual pieces 26, 27 and 28 hold the device together in the proper configuration.

Figure 6D:
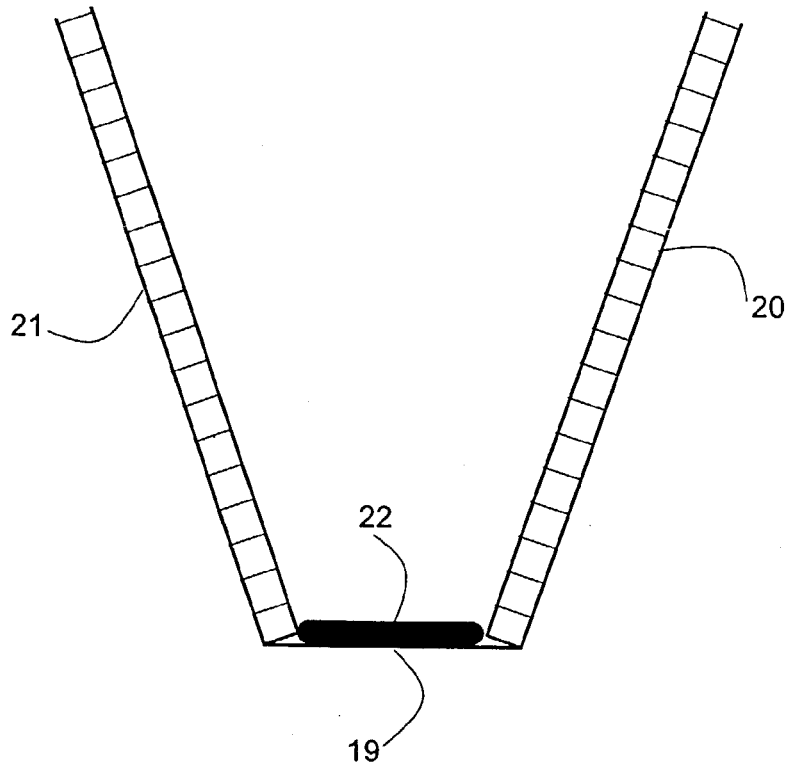
Figure 6E:
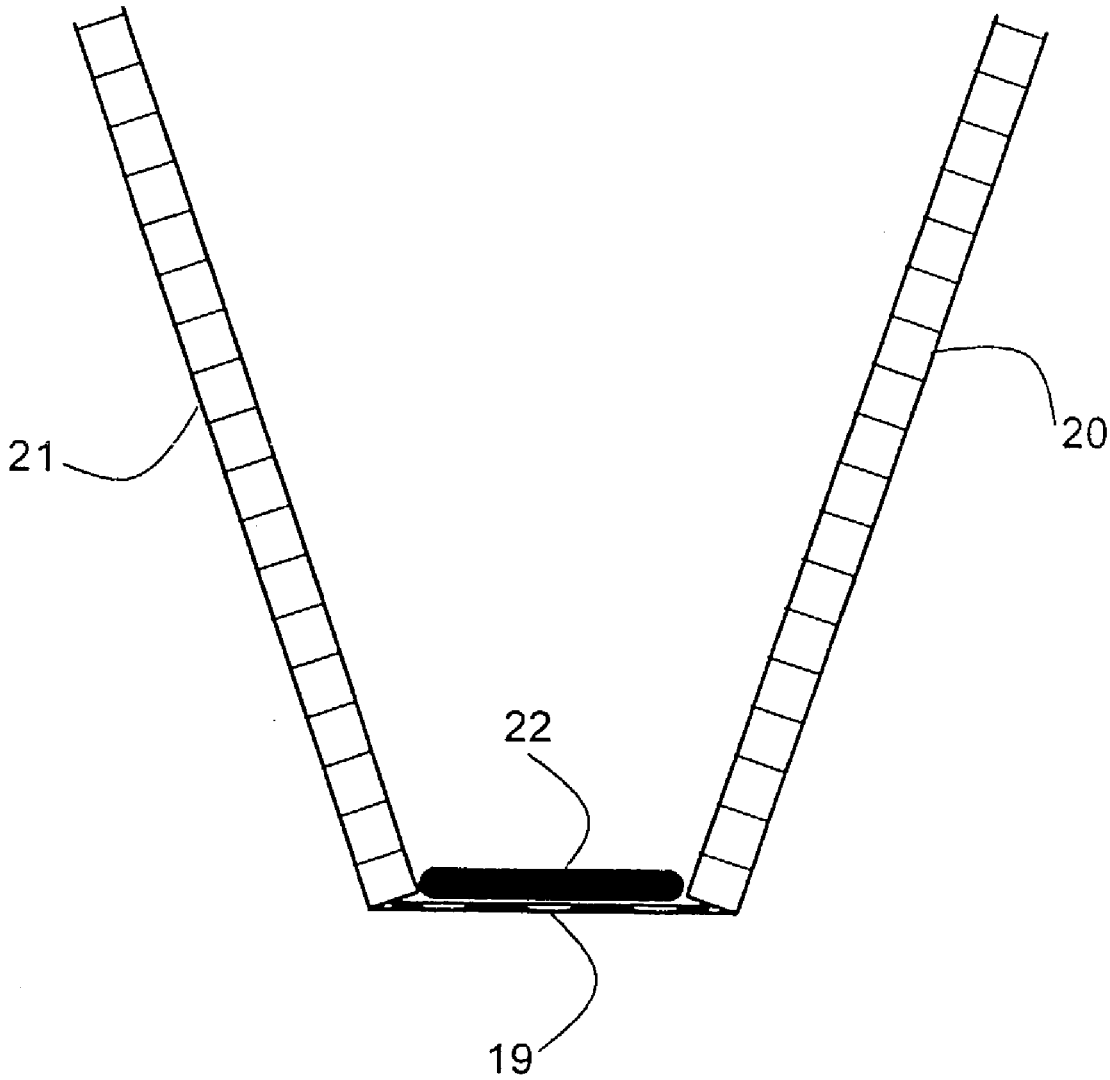

In another method of fabricating the device, as depicted in FIG. 6D, a portion of the upper facing material and a portion of the ribbed or corrugated material is removed or, as depicted in FIG. 6E, the thickness dimension of the ribbed or corrugated material is reduced, such as by pressing in a heated condition, to reduce the depth of the corrugation or ribs. In the embodiments of both 6D and 6E the resulting void or depression serves as a nesting place for the wicking material 22. Such arrangement facilitates storing and shipping of the device, as the device can be layed flat to present a substantially uniform thickness to facilitate stacking and packaging in a compact manner.

Figure 7:
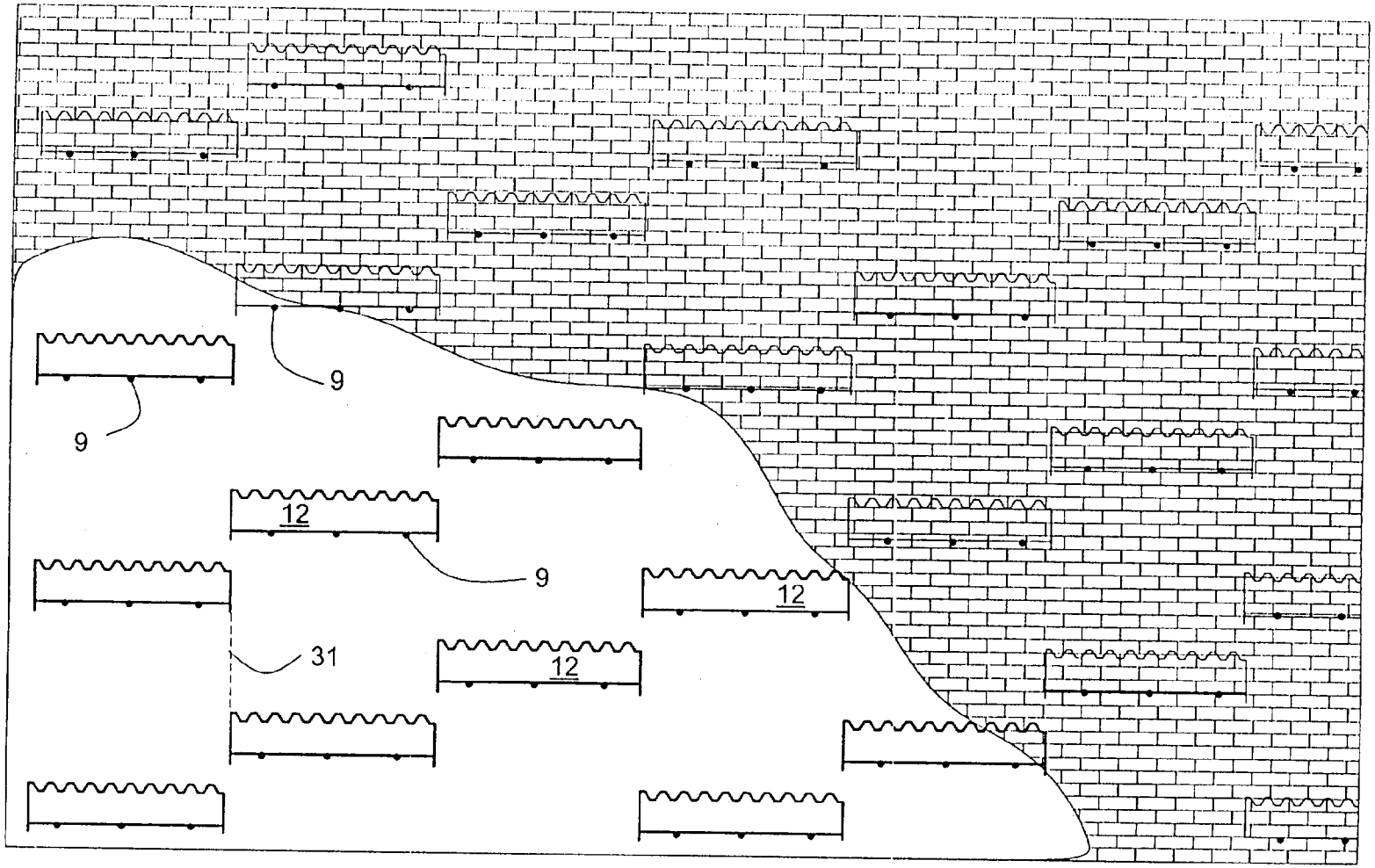
FIG. 7 is a front elevational view, having a section cut away, of a structure having cavity wall construction with a water and water vapor removal system of the invention installed.

A preferred pattern of installation for the devices of the invention is shown in FIG. 7. Other staggered placement patterns, which prevent the accumulation of trash mortar at the base of the cavity are within the scope of the invention. The pattern is achievable using the placement of masonry ties 9 which is practiced by many masonry tradesmen and specified in many construction documents. As shown in FIG. 7, the devices 12 are arranged in a step-like staggered configuration and each device is supported by three ties. Vertical alignment between ends of devices in different courses is preferred, such as shown between two devices at indicator 31. The alignment is in relation to vertical lines extending from ends of the devices. Although alignment of the ends is preferred, some overlap or a gap between the ends do not diminish the effectiveness significantly. A placement pattern, as shown, is easily followed by a masonry tradesman accustomed to utilizing masonry ties, which have been located in the structural back-up wall in the above-described conventional manner. In the pattern, each end of each device 12 is in vertical alignment with an end of another device 12 in a next course having the inserted masonry ties 9.

During the construction phase of a building, placement of the devices in a pattern as shown in FIG. 7 provides a comprehensive system for catching and retaining trash mortar so as to prevent it from reaching the weep system at the base of the walls. The modified "V" shape of the device prevents mortar, which is contained by the device, from bridging or contacting either of the walls. Such contact could provide confined spaces for retaining moisture or provide mortar bridging to carry water from the inside of the exterior masonry wall 5 to the structural back-up wall 4, which is to be avoided.

Following the construction phase of a building, the devices of the invention perform a second function of collecting water and promoting its travel toward the weep system. In operation, any water present on any upward facing portion of the device travels by gravity to be absorbed by the wicking material 22. Following absorption by the wicking material, the wicking action draws the water to be substantially evenly distributed in the wicking material. As water is drawn into portions of the wicking material near ends which are preferably extended vertically downward from the device, gravitational force as well as the wicking action acts on the water to move it toward the lower ends of the wicking material. Drops of water, which are formed at the ends, drop from the wicking material to a next lower device of the invention. With use of the placement pattern shown in FIG. 7 the dropping water preferably reaches the next lower device near one of its ends, and movement to the end and onto a device located beneath it occurs over a short period of time. Such path of travel results in removal of water from between the walls in an efficient manner. Such path of travel results in removal of water in a shorter period of time as compared with a known water control system having no wick and having "drip holes" spaced along the length of the device, which results in the water dropping to a similar location of the next lower device, thus providing a relatively slow water elimination process. The generally "modified V" shaped configuration of each of the present devices positions the lowered ends of the wicking material near a center of the cavity in relation to the exterior masonry wall and the structural back-up wall, thus preventing the water from contacting either of the walls and possibly causing damage to materials of the walls.

While specific materials, dimensional data, fabricating steps, etc., have been set forth for purposes of describing embodiments of the invention, various modifications can be resorted to, in light of the above teachings, without departing from the novel contributions; therefore in determining the scope of the present invention, reference shall be made to the appended claims.

What is claimed is:

1. A device for use in masonry cavity wall construction for collecting trash mortar and promoting removal of water and water vapor when said device is placed in a cavity between an exterior masonry wall and a structural back-up wall, said device comprising an elongated open ended trough having ends and a base portion extending between said ends thereof, for insertion during construction between the exterior masonry wall and the structure back-up wall, to retain trash mortar and prevent it from dropping below the location of insertion, and a water wicking means disposed on said base portion and extending between said ends and furtherly extending downwardly from said ends, for transporting water present on said trough to portions of the wicking means extending downwardly, for movement of the water to a location in the cavity which is below the location of insertion.

2. The masonry cavity wall device as defined in claim 1, wherein said open-ended trough, having a substantially "V" shape in cross-section perpendicular to its longitudinal axis, configured for placement during construction with a vertex in a substantially horizontal orientation and bearing on masonry ties extending between said exterior masonry wall and said structural back-up wall in a manner with longitudinal top edges of the trough in contact with said walls.

3. The masonry cavity wall device as defined in claim 2, wherein said longitudinal top edges of the trough have an undulating pattern so as to provide periodic ventilating spaces between said walls and said longitudinal top edges.

4. The masonry cavity wall device as defined in claim 3, wherein said substantially "V" shape cross-section includes a narrow elongated portion between two vertexes with said narrow elongated portion being configured to be horizontally orientated when placed on said masonry ties extending between said walls.

5. The masonry cavity wall device as defined in claim 4, wherein said wicking means is an elongated wicking material of a length greater than said open-ended trough, disposed at least to coincide with said narrow elongated portion of said open-ended trough and to extend downwardly from ends of said open-ended trough.

6. The masonry cavity wall device as defined in claim 5, wherein said wicking means is held in place by staples, adhesive, or other means.

7. The masonry cavity wall device as defined in claim 2, wherein said open-ended trough is fabricated of a rigid, substantially planar material having resistance to deterioration from exposure to water, water vapor, and masonry materials of the walls.

8. The masonry cavity wall device as defined in claim 7, wherein said open-ended trough material is a polymer material or metal.

9. The masonry cavity wall device as defined in claim 8, wherein said open-ended trough material is polypropylene-ethylene copolymer.

10. The masonry cavity wall device as defined in claim 8, wherein said material is in the form of a solid sheet, a perforated sheet, or a woven structure.

11. The masonry cavity wall device as defined in claim 8, wherein said open-ended trough material has a faced corrugated structure or a faced ribbed structure.

12. The masonry cavity wall device as defined in claim 8, wherein said open-ended trough material is an unfaced corrugated structure.

13. The masonry cavity wall device as defined in claim 11 wherein said open-ended trough material is polypropylene-ethylene copolymer.

14. The masonry cavity wall device as defined in claim 11, wherein said open-ended trough material is oriented to have said corrugations or said ribs extending in the longitudinal direction of said open-ended trough.

15. The masonry cavity wall device as defined in claim 11, wherein said open-ended trough material is oriented to have said corrugations or said ribs extending in a direction perpendicular to the longitudinal direction of said open-ended trough.

16. The masonry cavity wall device as defined in claim 14, wherein said material has a double-faced structure and material at each vertex of said open-ended trough is severed on one face of said double-faced material along the length of each vertex.

17. The masonry cavity wall device as defined in claim 15, wherein said material has a double-faced structure and material at each vertex of said open-ended trough is severed at furrow and ridge forming material and on one face of said double-faced material along the length of each vertex.

18. The masonry cavity wall device as defined in claim 4, wherein said open-ended trough is fabricated of 3 separate pieces of a substantially planar material, and said device further includes an adhesively backed polymer material for holding said separate pieces of substantially planar material in the substantially "V" shape configuration.

19. The masonry cavity wall device defined in claim 4, wherein said open-ended trough is fabricated of 3 separate pieces of a substantially planar material, and said device further includes an adhesive layer attaching said wicking means to said separate pieces of substantially planar material to hold said separate pieces in the substantially "V" shape configuration.

20. The masonry cavity wall device as defined in claim 4, wherein said wicking material is of a width to cover said narrow elongated portion and extend at least part way up surfaces of the open-ended trough which extend from each said vertex toward said longitudinal top edges of the trough.

21. The masonry cavity wall device as defined in claim 11, wherein said trough material has a double-faced corrugated or ribbed structure, the corrugation or rib forming material, and an upper face material of the trough material is removed in said narrow elongated portion of said open-ended trough, and said wicking means is disposed on a remaining facing material of the trough material in said narrow elongated portion of the trough.

22. The masonry cavity wall device as defined in claim 11, wherein said trough material has a single-faced corrugated or ribbed structure, the corrugation or rib forming material is removed in said narrow elongated portion of said open-ended trough, and said wicking means is disposed on a remaining facing material of the trough material in said narrow elongated portion.

23. The masonry cavity wall device as defined in claim 11, wherein the corrugation or rib forming material, is reduced in depth in said narrow elongated portion of said open-ended trough, and said wicking means is disposed on material of said narrow elongated portion.

24. The masonry cavity wall device as defined in claim 11, wherein said open-ended trough corrugated material is formed from a sheet material having a thickness in a range of 0.005 and 0.05 inch, a rib or corrugation depth is in a range of 1/32 to 1/2 inch, and the length of said open-ended trough is between about 32 and 96 inches.

25. The masonry cavity wall device as defined in claim 10, wherein said open-ended trough material is a solid or perforated sheet having a thickness in a range of 0.005 to 0.2 inch, and the length of said open-ended trough is between 32 and 96 inches.

* * * * *